US007471883B2

(12) United States Patent
Seutter et al.

(10) Patent No.: US 7,471,883 B2
(45) Date of Patent: Dec. 30, 2008

(54) BABY WARMER ADAPTED FOR INDIRECT ILLUMINATION AND METHOD OF USE

(76) Inventors: Jess Micah Seutter, 51473 RR #233, Sherwood Park, Alberta (CA) T8B 1L1; Christal G. Seutter, 51473 RR#233, Sherwood Park, Alberta (CA) T8B 1L1

( * ) Notice: Subject to any disclaimer, the term of this patent is extended or adjusted under 35 U.S.C. 154(b) by 0 days.

(21) Appl. No.: 11/444,580

(22) Filed: May 31, 2006

(65) Prior Publication Data

US 2008/0193111 A1 Aug. 14, 2008

Related U.S. Application Data

(63) Continuation-in-part of application No. 10/984,395, filed on Nov. 8, 2004, now abandoned.

(51) Int. Cl.
*A47J 27/00* (2006.01)

(52) U.S. Cl. ..... 392/381; 392/379; 34/90; 34/96

(58) Field of Classification Search ..... None
See application file for complete search history.

(56) References Cited

U.S. PATENT DOCUMENTS

| | | | |
|---|---|---|---|
| 4,206,556 | A | 6/1980 | Sabo et al. |
| 5,103,577 | A | 4/1992 | Michaels et al. |
| D326,148 | S | 5/1992 | Lawlor |
| D328,949 | S | 8/1992 | Rodrigue, Jr. |
| 5,394,620 | A | 3/1995 | Chimera |
| 5,725,356 | A | 3/1998 | Carter |
| 5,816,910 | A | 10/1998 | Steele et al. |
| D404,733 | S | 1/1999 | Crosby |
| 5,873,178 | A | 2/1999 | Johnson |
| 6,027,137 | A | 2/2000 | Rura |

FOREIGN PATENT DOCUMENTS

| | | |
|---|---|---|
| CH | 421405 | 3/1967 |
| DE | 19755084 | 6/1999 |
| FR | 1122680 | 9/1956 |
| FR | 2607684 | 8/1986 |
| GB | 915674 | 11/1960 |
| GB | 972682 | 10/1964 |

*Primary Examiner*—Thor S Campbell
(74) *Attorney, Agent, or Firm*—Gene Scott; Patent Law & Venture Group

(57) ABSTRACT

An electric heater and a fan are enclosed within a cylindrical case for blowing warmed air from one end of the case. The case is supported at a distal end by a flexible strut enabling selective positioning of the case for directing the warmed air in a preferred direction. The flexible strut is rotationally engaged in a base. The base supports the flexible strut and the case in a selectable orientation. A lamp is fixed to the underside of the case in a position for directing illumination downwardly; the lamp positioned such that a forward end of the case provides shadowing of the light from a baby's eyes.

7 Claims, 2 Drawing Sheets

BABY WARMER ADAPTED FOR INDIRECT ILLUMINATION AND METHOD OF USE

CROSS-REFERENCE TO RELATED APPLICATIONS

This is a Continuation-In-Part application of U.S. patent application Ser. No. 10,984,395, filed Nov. 8, 2004 now abandoned before the United States Patent & Trademark Office.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC

Not applicable.

REFERENCE TO A "MICROFICHE APPENDIX"

Not applicable.

BACKGROUND OF THE INVENTION

1. Field of the Present Disclosure

This invention relates generally to hot air blowers and lamps and more particularly to a combination heated air blower and lamp combination particularly adapted for use in changing a baby's diaper.

2. Description of Related Art Including Information Disclosed Under 37 CFR 1.97 and 1.98

Lee et al, U.S. Pat. No. 5,940,980 discloses a hands-free hair dryer which includes a hair dryer body including heating element and fan, an elongated bendable tubing connected at one end to the hair dryer body, and preferably a spring clamp secured to the other end of the tubing. The tubing is capable of being bent to any desired position or angle where it remains until it is re-positioned. The spring clamp can be attached to any desired surface or support such as a counter, door, towel rack, cupboard, etc. The device allows very convenient hands-free use of the dryer for a variety of purposes.

Becker Andrea Beate, DE19755084, discloses a skin dryer having a casing accommodating a fan, a heating element and an electric drive. A rechargeable battery is positioned inside the handle. The dryer is operated with a low voltage and the released air is of a temperature convenient for the baby's skin. The heater, the fan and an integrated lamp are operated by three individual control buttons. There is also a version available which can be connected to the cigarette lighter in a car.

Fielden et al, U.S. Pat. No. 6,357,710, describes an item holding device, having a multi-segmented arm wherein each segment connected to each adjacent segment by a swivel joint having a substantial fictional resistance to motion, wherein a first quick release clamp is provided on one end of the arm, wherein a second such clamp or the base of an item is provided on the other end of the arm, and wherein the first clamp is adapted for gripping an action-site member whereby an item can be held in a desired position at the action-site.

Simons, U.S. Pat. No. 1,786,459, discloses a bottle holder comprising a base, an arm attached thereto and a bottle holding means on said arm, said base being of a size and weight sufficient to maintain said holder in an upright position when said base is resting on a supporting surface, and having a clamping member attached thereto whereby said holder may be clamped to a support.

Crowley et al, U.S. Pat. No. 4,550,358, discloses a non-resettable water actuated circuit interrupting means for use with a portable electric appliance such as a hair dryer to provide protection for the user against injury in the event that the appliance is accidentally dropped in water or otherwise develops leakage current. Both sides of the line are fused and circuit means are provided which respond to leakage current in the appliance to provide separate circuits to blow out each of the fuses.

Ambosiano, U.S. Pat. No. 6,080,974, discloses a clothes and linen-warming or dehumidification apparatus includes resistive means for producing heat by the Joule effect and an electrically insulating and thermally-conducting container containing the resistive means including at least one layer of resistive material arranged in track form, with the at least one layer of resistive material having a non-homogeneous distribution such that it produces less heat in a central region of the apparatus Cook, U.S. Pat. No. 2,150,542, discloses a flood light support mounting held by a spring clip to a wall fixture base and an outwardly extending finger arranged to enable the user to removably mount an item at an elevated position within a room by merely attaching the spring clip to the wall-mounted finger.

Prohaczka et al, U.S. Pat. No. 2,909,316, discloses a lamp that directs illumination primarily downwardly and perpendicular to the flow of air generated by a fan. This arrangement directs most of the light in a different direction than the air, thus primarily illuminating the area below the apparatus.

The prior art teaches hot air blowers, lamps, and combinations thereof. However, the prior art does not teach a hot air blower that is mounted on a flexible stand so that it may be set to direct hot air at a baby on the same surface as the apparatus and which produces a downwardly directed lamp illumination that is positioned on the device so as to be shadowed by the device from the eyes of a baby laying in the path of the hot air. The present invention fulfills these needs and provides further related advantages as described below.

BRIEF SUMMARY OF THE INVENTION

This disclosure teaches certain benefits in construction and use which give rise to the objectives described below.

A hot air blower is supported by an upright flexible strut enabling selective positioning of the blower for directing the warmed air in a preferred direction. A lamp is fixed to the underside of the case in a position for directing illumination downwardly; the lamp positioned such that a forward end of the case provides shadowing of the light from a baby's eyes.

A primary objective inherent in the above described apparatus and method of use is to provide advantages not taught by the prior art.

Another objective is to provide a hot air blower supported on surface by a flexible mount so that it may be positioned for directing hot air in a selected direction.

A further objective is to provide such a blower having a source of illumination positioned on the blower's underside such that the case is able to shadow the illumination from the eyes of a baby lying on the supporting surface.

Other features and advantages of the present invention will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWING(S)

Illustrated in the accompanying drawing(s) is at least one of the best mode embodiments of the present invention. In such drawing(s):

DETAILED DESCRIPTION OF THE INVENTION

The above described drawing figures illustrate the described apparatus and its method of use in at least one of its preferred, best mode embodiment, which is further defined in detail in the following description. Those having ordinary skill in the art may be able to make alterations and modifications what is described herein without departing from its spirit and scope. Therefore, it must be understood that what is illustrated is set forth only for the purposes of example and that it should not be taken as a limitation in the scope of the present apparatus and method of use.

Figure 1:
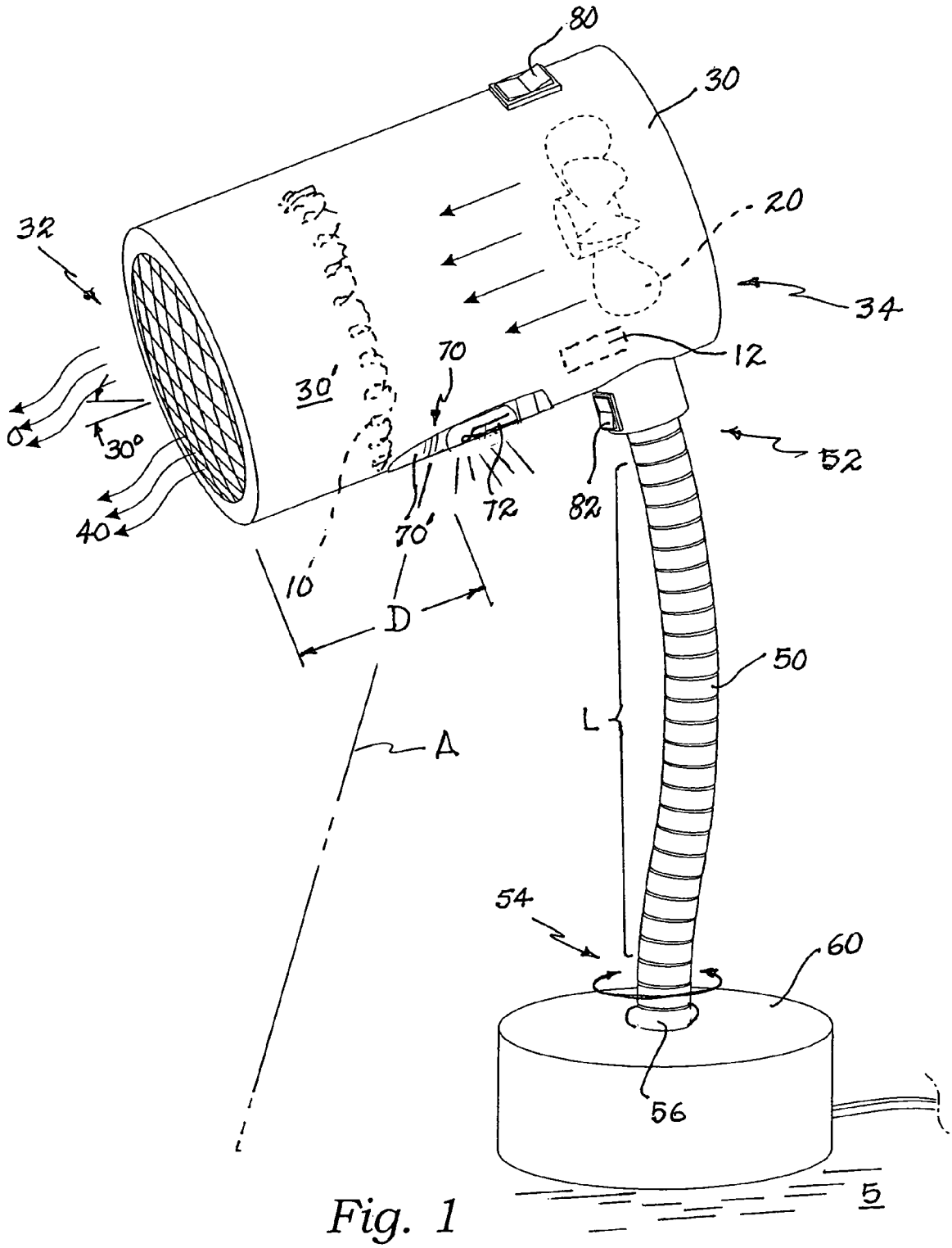
FIG. 1 is a perspective view of the presently described apparatus.

In one embodiment of the present invention an electric heater 10, such as an electric coil, and a fan 20 are both supported within a cylindrical case 30 for blowing heated air 40 from forward end 32 of the case 30. Room air is drawn in at the opposing end 34 of the case 30 as is well known in the art. The case 30 is supported at a distal end 52 of a flexible strut 50, of the type used with a goose neck lamp, enabling selective positioning of the forward end 32 of the case 30 for directing the warmed air 40 in a selected direction and preferably downward at an angle as shown in FIG. 1. A base 60 is engaged with a proximal end 54 of the flexible strut 50, the base 60 supporting the flexible strut 50 and the case 30 in a selected orientation, as shown in FIG. 1. Preferably, a swivel link 56 engages the proximal end 54 of the flexible strut 50 with the base 60 so that the entire strut 50 is able to rotate relative to the base 60. A lamp 72 is mounted within the case 30 behind a window 70. Window 70 has an exterior window surface 70' conforming to the exterior case surface 30' as shown. Window 70 is located medially on case 30 and is directed downwardly toward the supporting surface 5. Thus, illumination from lamp 72 is directed downwardly. With the case 30 positioned for directing the heated air 40 downwardly at an approximately 30 degree angle relative to the horizontal as shown in FIG. 1, direct illumination is projected onto surface 5 no further forward than the forward end 32 of case 30 as indicated by line "A".

Figure 2:
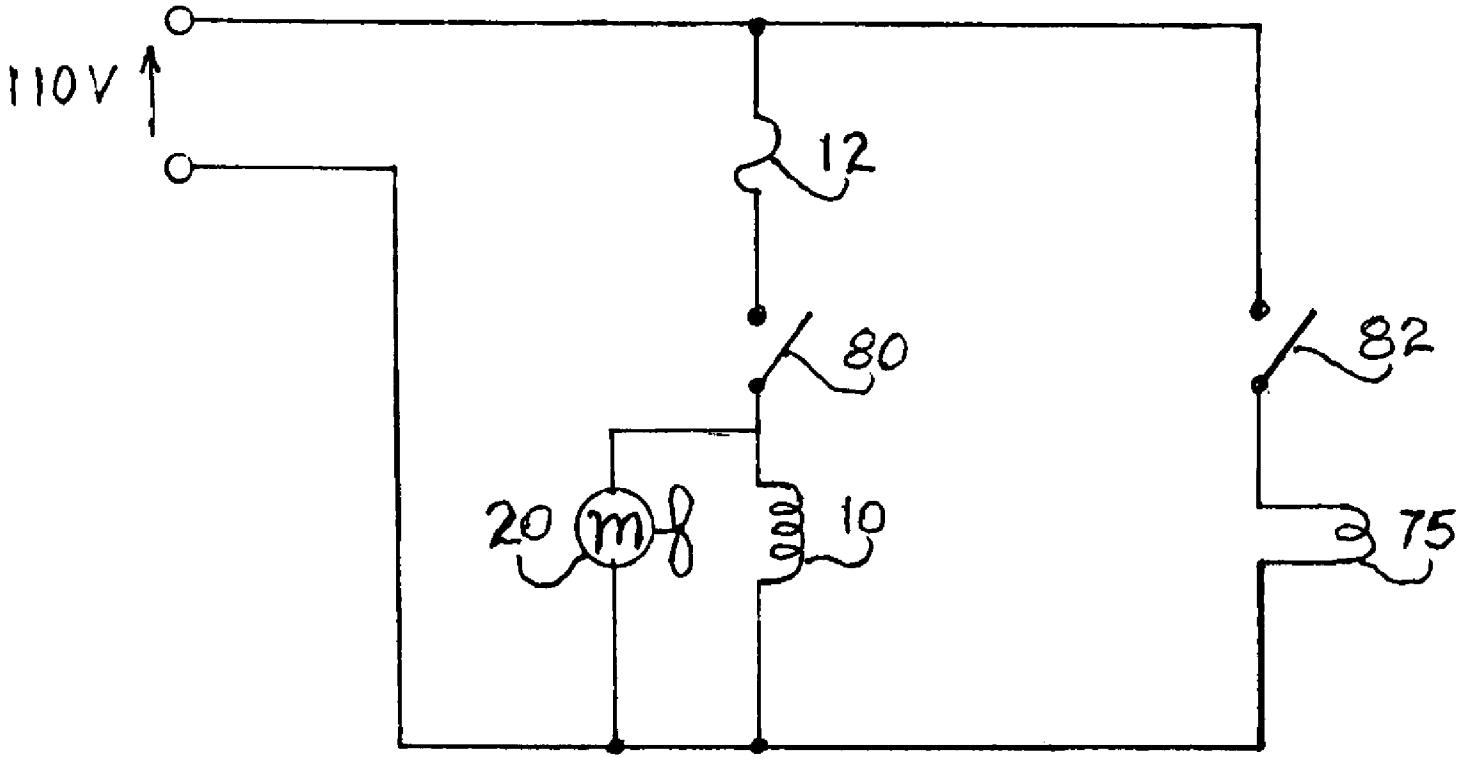
FIG. 2 is an electrical schematic diagram thereof.

As shown in FIG. 2, a first power switch 80 is incorporated for energizing the electric heater 10 and fan 20, while a second power switch 82 is incorporated for energizing the lamp 70. An over-current sensor or fuse 12 is incorporated into the circuit of the heater and fan 10, 20 for preventing high current flow in case of a short circuit.

Preferably, the base 60 is a heavily weighted member so as to stabilize the apparatus when in an upright attitude. Alternately, as shown in FIGS. 2 and 3, a spring clip 62 is provided with sufficient clamping strength as to hold the apparatus in an attitude extending horizontally from the spring clip 62, as shown in FIG. 3.

The apparatus is highly advantageous for changing a baby's diaper at night. The lamp 70 is in a position where its illumination is shadowed by the forward end 32 from the eyes of the baby lying on the supporting surface 5 for receiving the heated air blowing from the forward end 32. It is clear that in order to direct heated air to dry a baby's bottom area, and simultaneously to provide general illumination without directing light into the baby's eyes, the apparatus must provide a combination of structural features that work together to achieve the desired end result. In the present apparatus we have adjusted the length "L" (FIG. 1) of strut 50 which determines the height of the case 30 above the support surface 5. Of course, "L" can also be adjusted slightly by bending strut 50. The lamp 70 is positioned well back from the forward end 32, i.e., medially positioned as shown by distance "D" so that with a slight (30 degrees or so) downward tilt of the case (bending of the strut) the forward end 32 acts to shadow direct illumination from reaching the baby. Finally, the lamp 70 is placed within the case's exterior surface 30'. These three parameters are adjusted in the instant apparatus so that light is not directed forward but rather is controlled in the downward direction with no direct illumination projected forward of the forward end 32 of the case 30, yet bright enough for providing enough illumination for the nurse or mother to see well enough to change the baby's diaper notice a rash and other duties.

The enablements described in detail above are considered novel over the prior art of record and are considered critical to the operation of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. An apparatus supported on a supporting surface, the apparatus comprising: an electric heater and a fan both engaged within a tubular case thereby enabling warm air to be directed from a forward end of the case, the case having an exterior case surface; the case positioned in a generally horizontal attitude above the supporting surface by a flexible strut; a lamp positioned within the case behind a window, the window having an exterior window surface conforming to the exterior case surface; the window positioned medially on the case and directed downwardly toward the supporting surface; the flexible strut movable for directing the warm air from the case to a baby lying on the supporting surface while the illumination is shadowed from the baby by the forward end of the case primarily due to the position of the lamp within the case.

2. The apparatus of claim 1 further comprising a first electrical switch engaged for control of the heater and fan.

3. The apparatus of claim 2 further comprising a second electrical switch engaged for control of the lamp.

4. The apparatus of claim 1 wherein the lamp is positioned on the case, and the flexible strut is of such length, that with the warmed air directed downward at an angle of approximately 30 degrees with the horizontal, direct illumination from the lamp is projected onto the supporting surface no further forward of the forward end of the case.

5. A method of drying, warming and illuminating a baby on a supporting surface without direct illumination falling on the baby comprising the steps of:

a) engaging an electric heater and a fan a tubular case thereby enabling warm air to be directed from a forward end of the case, the case having an exterior case surface;

b) positioning the case in a generally horizontal attitude above the supporting surface by a flexible strut;

c) positioning a lamp within the case behind a medially positioned window directed downwardly toward the supporting surface, the window having an exterior window surface conforming to the exterior case surface;

d) directing warm air from the case to a baby lying on the supporting surface by moving the flexible strut; and e) shadowing illumination from the baby using the forward end of the case.

6. The method of claim 5 further comprising the step of controlling the heater and fan with a first electrical switch.

7. The method of claim 5 further comprising the step of controlling the lamp with a second electrical switch.

* * * * *